US009908019B1

(12) United States Patent
Seluga

(10) Patent No.: US 9,908,019 B1
(45) **Date of Patent: *Mar. 6, 2018**

(54) GOLF CLUB HEAD WITH CENTER OF GRAVITY ADJUSTABILITY THAT OPTIMIZES PRODUCTS OF INERTIA

(71) Applicant: Callaway Golf Company, Carlsbad, CA (US)

(72) Inventor: James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/659,418

(22) Filed: Jul. 25, 2017

Related U.S. Application Data

(63) Continuation of application No. 14/964,066, filed on Dec. 9, 2015, now Pat. No. 9,717,962.

(60) Provisional application No. 62/093,282, filed on Dec. 17, 2014.

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/045* (2013.01); *A63B 2053/0408* (2013.01); *A63B 2053/0433* (2013.01); *A63B 2053/0491* (2013.01); *A63B 2053/0495* (2013.01)

(58) Field of Classification Search
CPC ..... A63B 53/06; A63B 53/0466; A63B 2053/045; A63B 2053/0408; A63B 2053/0433; A63B 2053/0491; A63B 2053/0495
USPC ..... 473/332, 334, 338, 339, 344, 345, 346, 473/348, 349, 350
See application file for complete search history.

(56) References Cited

U.S. PATENT DOCUMENTS

| | | | | |
|---|---|---|---|---|
| 2,225,930 | A * | 12/1940 | Sexton | A63B 53/08 473/338 |
| 3,652,094 | A * | 3/1972 | Glover | A63B 53/08 473/337 |
| 4,811,949 | A * | 3/1989 | Kobayashi | A63B 53/04 473/337 |
| 6,379,265 | B1 * | 4/2002 | Hirakawa | A63B 53/04 473/338 |
| 6,669,580 | B1 * | 12/2003 | Cackett | A63B 53/02 473/345 |
| 7,014,393 | B2 * | 3/2006 | Matheis | B23B 27/1681 407/37 |
| 7,445,563 | B1 * | 11/2008 | Werner | A63B 53/0466 473/332 |
| 9,717,962 | B1 * | 8/2017 | Seluga | A63B 53/06 |
| 2011/0224017 | A1 * | 9/2011 | Thomas | A63B 53/0466 473/332 |

(Continued)

*Primary Examiner* — Benjamin Layno
(74) *Attorney, Agent, or Firm* — Michael A. Catania; Rebecca Hanovice; Sonia Lari

(57) ABSTRACT

The present invention comprises a golf club head comprising a body having a crown, a sole, a front wall and a hosel, wherein the body defines a hollow interior. The golf club head further comprises a center of gravity height adjustment assembly wherein the center of gravity height adjustment assembly is positioned within the hollow interior of the body. The products of inertia (Ixz and Iyz) of the golf club head have an absolute value below 100 g-cm$^2$.

13 Claims, 10 Drawing Sheets

(56) References Cited

U.S. PATENT DOCUMENTS

2015/0343282 A1* 12/2015 Franklin ..... A63B 53/04
473/333

* cited by examiner

| Weight movement | 10 | grams | CG height | 0.080 | | | |
|---|---|---|---|---|---|---|---|
| Sole | Crown | Depth low | Height low | Depth High | Height High | Delta Depth | Delta Height |
| 1 | 1 | 1.106 | 0.095 | 1.14 | 0.236 | 0.034 | 0.141 |
| 1 | 2 | 1.121 | 0.094 | 1.22 | 0.228 | 0.099 | 0.134 |
| 1 | 3 | 1.128 | 0.091 | 1.258 | 0.213 | 0.13 | 0.122 |
| 1 | 4 | 1.135 | 0.087 | 1.298 | 0.193 | 0.163 | 0.106 |
| 2 | 1 | 1.226 | 0.126 | 1.162 | 0.241 | 0.064 | 0.115 |
| 2 | 2 | 1.241 | 0.124 | 1.241 | 0.234 | 0 | 0.11 |
| 2 | 3 | 1.248 | 0.122 | 1.28 | 0.218 | 0.032 | 0.096 |
| 2 | 4 | 1.255 | 0.118 | 1.32 | 0.199 | 0.065 | 0.081 |
| 3 | 1 | 1.26 | 0.139 | 1.169 | 0.244 | -0.091 | 0.105 |
| 3 | 2 | 1.281 | 0.137 | 1.249 | 0.236 | -0.032 | 0.099 |
| 3 | 3 | 1.288 | 0.135 | 1.287 | 0.221 | -0.001 | 0.086 |
| 3 | 4 | 1.295 | 0.131 | 1.327 | 0.201 | -0.032 | 0.07 |
| 4 | 1 | 1.308 | 0.154 | 1.177 | 0.246 | -0.131 | 0.092 |
| 4 | 2 | 1.322 | 0.152 | 1.256 | 0.239 | -0.066 | 0.087 |
| 4 | 3 | 1.329 | 0.149 | 1.295 | 0.223 | -0.034 | 0.074 |
| 4 | 4 | 1.336 | 0.146 | 1.334 | 0.204 | -0.002 | 0.058 |

GOLF CLUB HEAD WITH CENTER OF GRAVITY ADJUSTABILITY THAT OPTIMIZES PRODUCTS OF INERTIA

CROSS REFERENCES TO RELATED APPLICATIONS

The Present Application is a continuation application of U.S. patent application Ser. No. 14/964,066, filed on Dec. 9, 2015, now U.S. Pat. No. 9,717,962, which claims priority to U.S. Provisional Patent Application No. 62/093,282, filed on Dec. 17, 2015, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf club head comprising a center of gravity height adjustability assembly.

Description of the Related Art

The prior art discloses various designs with center of gravity adjustments to improve golf club performance.

The prior art fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The purpose of this invention is to effectively incorporate several design features in the golf club head that will enable adjustment of the height of the center of gravity.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the center of gravity is adjustable.

The products of inertia relate moments about one axis with head rotations about another axis. These head rotations in turn cause vertical or horizontal gear effect that impart increased or reduced backspin and draw or fade spin to a golf ball. Unlike the spins generated by conventional gear effect associated with Iyy and Izz, these spins cannot be compensated for by adjusting the face bulge radius and the face roll radius. As club heads become larger than 300 cc, and moments of inertia become larger, Izz greater than 3000 grams centimeter squared and Iyy greater than 1800 grams, there is a propensity for the products of inertia to also become larger. As the products of inertia become larger, there is a deleterious effect on dispersion.

BRIEF SUMMARY OF THE INVENTION

The main objective of the present invention is to improve the location of the height of the center of gravity. To improve the height of the center of gravity, a golf club head is created which has center of gravity height adjustment assembly. This multiple designs enabling adjustment of the center of gravity can affect the moment of inertia and ultimately the forgiveness of the golf club head.

The present invention provides a large volume golf club head with high moments of inertia that has smaller products of inertia. The golf club head of the present invention provides all of the advantages of large volume golf club heads with large moments of inertia, such as greater confidence and greater distance, without the attendant increase in dispersion. Thus, off-center hits have greater distance and increased straightness with the golf club head of the present invention, which results in more consistent golf ball flight and improved accuracy for the golfer.

Another object of the present invention is an adjustable weighting feature for vertical center of gravity control which is placed to maximize effectiveness and may be entirely concealed from view at address.

One aspect of the golf club head of the present invention comprises a body having a crown, a sole, a face and a hosel, wherein the body defines a hollow interior; and a center of gravity height adjustment assembly wherein the center of gravity height adjustment assembly is positioned within the hollow interior of the body. Preferably, the center of gravity of the golf club head can be adjusted approximately 0.050 inch and 0.100 inch.

Another aspect of the present invention is a wood-type golf club head comprising a body comprising a face, a hosel, a rear portion, and a metal sole, a crown composed of a carbon material, a hollow tube composed of a carbon material, and a cartridge comprising a first material having a first specific gravity and a second material having a second specific gravity that is greater than the value of the first specific gravity, wherein the tube is disposed within a hollow interior of the golf club head and extends from the crown to the sole, wherein the cartridge is sized to fit within the tube, wherein the tube is accessible via an opening in the sole, and wherein changing the orientation of the carrier within the tube changes the location of the golf club head's center of gravity along a vertical Z axis. In some embodiments, the first material may be a polymer and the second material may be tungsten. In other embodiments, the tube may have a length of less than 3.8 inches and a mass 3.5 to 4.5 grams. In some embodiments, the wood-type golf club head may comprise cap sized to fit within the opening in the sole. In other embodiments, the body may be composed of a titanium alloy material. In some embodiments, the wood-type golf club head may further comprise at least one weight screw.

In still other embodiments, changing the orientation of the cartridge within the tube may change the location of the golf club head center of gravity by at least 0.050 inch along a vertical Z axis. In other embodiments, changing the orientation of the cartridge within the tube may change the location of the golf club head center of gravity by at approximately 0.070 inch along a vertical Z axis. In still other embodiments, changing the orientation of the carrier within the tube may change the location of the golf club head center of gravity by 0.068 to 0.085 inch, or no more than 0.100 inch along the vertical Z axis. In some embodiments, the golf club head may comprise an adjustable hosel or an adjustable plate on the sole. In still other embodiments, the tube may be disposed closer to the face than to the rear portion, and the cartridge may comprise a first tapered end and a second tapered end.

Another aspect of the present invention is a driver-type golf club head comprising a body composed of a titanium alloy comprising a face, a hosel, a rear portion, and a sole, a crown composed of a carbon material, a hollow tube composed of a carbon material, a cap screw, and a cartridge comprising a polymer and a slug composed of a material having a specific gravity that is greater than that of the polymer, wherein the tube is disposed within a hollow interior of the golf club head proximate the face and extends from the crown to the sole, wherein the cartridge is sized to fit within the tube, wherein the tube is accessible via an opening in the sole, wherein the cap screw is sized to close the opening in the sole and thereby reversibly fix the cartridge within the tube, and wherein reversing the orientation of the cartridge within the tube changes the location of the golf club head's center of gravity by no less than 0.050 inch and no more than 0.100 inch, or by 0.068 to 0.085 inch, along a vertical Z axis. In some embodiments, the tube may have a mass of no more than 4.5 grams. In other embodiments, the slug may be disposed at one end of the carrier. In some embodiments, the golf club head may have a mass M, the cartridge may have a length L and a mass $M_T$, the distance from the midpoint of the length L to a center of gravity of the tube when the cartridge is disposed within the tube such that the slug is closer to the sole may be defined as ½D, and the golf club head may satisfy the equation $D \geq 0.065(1+M/M_T)$.

Yet another aspect of the present invention is a golf club head comprising a tube and a cartridge comprising a low specific gravity material and a high specific gravity material, wherein the golf club head has a mass M, wherein the cartridge has a length L and a mass $M_T$, wherein the distance from the midpoint of the length L to a center of gravity of the cartridge when the cartridge is disposed within the tube is such that the high specific gravity material is closer to the sole is defined as ½D, and wherein the golf club head satisfies the equation $D \geq 0.065(1+M/M_T)$. In some embodiments, the golf club head may be a wood-type head comprising a titanium alloy sole, a titanium alloy face, and a composite crown, the tube may be composed of a composite material, the low specific gravity material may be a polymer, the high specific gravity material may be tungsten, and the tube may be disposed within a hollow interior of the driver and extend from the sole to the crown. In a further embodiment, reversing the orientation of the cartridge within the tube may change the location of the golf club head's center of gravity by approximately 0.070 inch along a vertical Z axis.

Another aspect of the present invention is a golf club head including a body having a crown, a sole and a striking plate. The body has a hollow interior. The golf club head has a volume ranging from 300 cubic centimeters ($cm^3$) to 600 $cm^3$. Each of the products of inertia, Ixy, Ixz and Iyz, of the golf club head have an absolute value less than 100 grams-centimeter squared (g-$cm^2$).

Another aspect of the present invention is a high moment of inertia golf club head having a body composed of a crown, a sole and a striking plate. A hollow tube is composed of a carbon material, and a cartridge comprising a first material having a first specific gravity and a second material having a second specific gravity that is greater than the value of the first specific gravity, wherein the tube is disposed within a hollow interior of the golf club head and extends from the crown to the sole, wherein the cartridge is sized to fit within the tube, wherein the tube is accessible via an opening in the sole, and wherein changing the orientation of the carrier within the tube changes the location of the golf club head's center of gravity along a vertical Z axis. The golf club head has a moment of inertia, Izz, about a vertical axis Z through the center of gravity of the golf club head that ranges from 3000 g-$cm^2$ to 5000 g-$cm^2$. The golf club head also has a moment of inertia, Iyy, about the horizontal axis Y through the center of gravity of the golf club head that ranges from 1900 g-$cm^2$ to 2050 g-$cm^2$. Each of the products inertia, Ixz and Iyz, of the golf club head have an absolute value less than 100 g-$cm^2$.

Another aspect of the present invention is a golf club head having a body composed of a titanium alloy material and having a mass less than 250 grams (g). A hollow tube is composed of a carbon material, and a cartridge comprising a first material having a first specific gravity and a second material having a second specific gravity that is greater than the value of the first specific gravity, wherein the tube is disposed within a hollow interior of the golf club head and extends from the crown to the sole, wherein the cartridge is sized to fit within the tube, wherein the tube is accessible via an opening in the sole, and wherein changing the orientation of the carrier within the tube changes the location of the golf club head's center of gravity along a vertical Z axis. The golf club head has a moment of inertia, Izz, about a vertical axis Z through the center of gravity of the golf club head that ranges from 3000 g-$cm^2$ to 5000 g-m'. The golf club head has a moment of inertia, Iyy, about the horizontal axis Y through the center of gravity of the golf club head that ranges from 1900 g-$cm^2$ to 2050 g-$cm^2$. Each of the products inertia, Ixz and Iyz, of the golf club head have an absolute value less than 100 g-$cm^2$.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
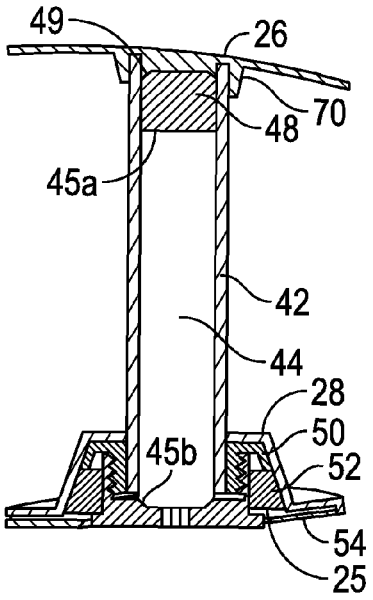
FIG. 1 is a cross sectional view of a golf club head comprising a first embodiment of a center of gravity height adjustment assembly.

The present invention relates to the design of a golf club head 20 having a body 22, the body having a crown 26, a sole 28, a face 30 and a hosel 32, wherein the body 22 defines a hollow interior 24; and a center of gravity height adjustment assembly 40. The center of gravity height adjustment assembly 40 is positioned within the hollow interior 24 of the body 22. Preferably the center of gravity of the golf club head 20 can be adjusted approximately 0.050 inch and 0.100 inch. The design approach described here is based on the construction used in the Callaway Golf Company RAZR Fit driver head, characterized by a composite crown adhesively bonded to a cast Titanium body. However, this center of gravity adjustment assembly may be used with other constructions including all Titanium, all composite and composite body with metal face cup. It is intended to work in conjunction with at least one adjustable weight port on the sole of the driver head.

Figure 14:
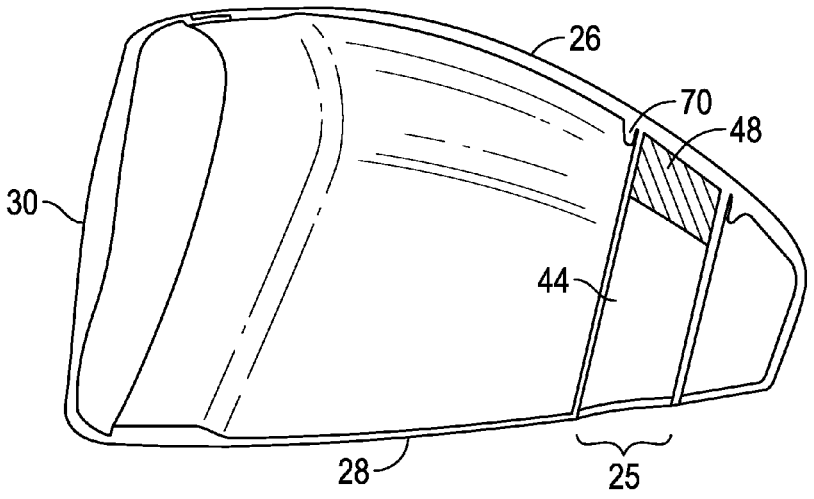
FIG. 14 is a cross-sectional view of the embodiment shown in FIG. 13 along lines 14-14 with no visible weight at address.

As shown in FIG. 1, in one embodiment of the present invention, the center of gravity height adjustment assembly 40 comprises a tube 42 and a carrier or cartridge 44. Preferably, the tube 42 is composed of a carbon material with an approximate mass ranging from 3.50 to 4.50 grams. The carrier or cartridge 44 preferably is composed of a polymer material, such as urethane, with an approximate mass ranging from 3.50 grams to 4.50 grams. A range of weight values can be achieved using loaded polymers or a polymer substrate with attached weights. High density polymers with sufficient bending flexibility exist with specific gravity values ranging from 1.8 to 4.2. Preferably, the tube 42 extends from the crown 26 to the sole 28, and the distance between the crown 26 to the sole 28 is less than 3.8 inches. The tube 42 preferably is accessed via an opening 25 in the sole 28 as shown in, for example, FIGS. 1, 4, and 14. The carrier or cartridge 44 comprises a first material and a second material, wherein the specific gravity of the first material is less than the specific gravity of the second material. The first material may be a slug 48, which preferably is composed of tungsten and has a mass ranging from 9.0 to 10.0 grams. The slug 48 preferably is disposed at a first end of the cartridge 44 as shown in FIGS. 1 and 14, such that the cartridge 44 has a heavy side and a light side. The center of gravity height adjustment assembly 40 may further comprise a cap 52, with an approximate weight of 4.65 grams and a cap nutplate 50 with an approximate weight of 2.86 grams. The center of gravity height adjustment assembly further comprises a skid plate 54 with an approximate weight of 2.82 grams.

Also referring to FIG. 1, in a preferred embodiment, the center of gravity height adjustment assembly 40 comprises a tube 42 having a mass of approximately 4.00 grams, a carrier or cartridge 44 having a mass of approximately 3.90 grams; a slug 48 having a mass of approximately 9.40 grams affixed to a first end 45*a* of the cartridge 44 and having a tapered end 49, a cap 52 having a mass of approximately 4.65 grams, a cap nutplate 50 having a mass of approximately 2.86 grams, and a skid plate 54 having a mass of approximately 2.82 grams. As shown in FIG. 1, the cartridge 44 preferably has a second end 45*b* that is also tapered. Preferably the golf club head 20 has an adjustable hosel 32.

Preferably, the driver type golf club head 20 has a volume of less than 400 cubic centimeters. Preferably, the body 22 is composed of a stainless steel material. In one embodiment, the sole 28 is composed of a metal material and the crown 26 is composed of a non-metal material. Alternatively, the body 22 is composed of a titanium alloy material.

Figure 2:
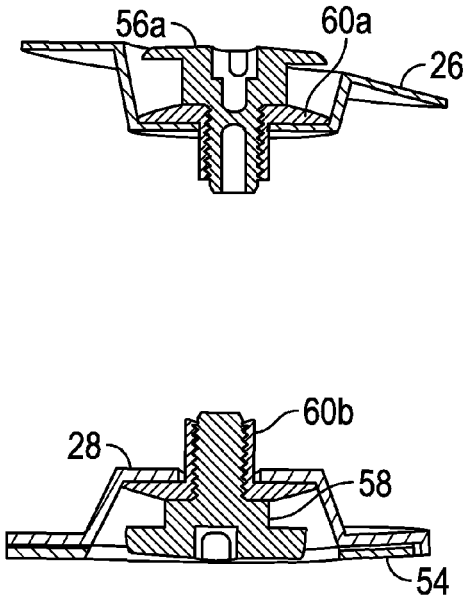
FIG. 2 is a cross sectional view of a golf club head comprising a second embodiment of a center of gravity height adjustment assembly.

As shown in FIG. 2, in a second embodiment, the center of gravity height adjustment assembly 40 comprises a first weight screw 56*a* and a second weight screw 58. Preferably first weight screw 56*a* has a mass with an approximate range of 9.50 grams to 10.50 grams. The second weight screw 58 has a range of mass of approximately 2.0 grams to 3.00 grams. The center of gravity height adjustment assembly 40 may further comprise a skid plate 54 and two nutplates (60*a* and 60*b*). In a preferred embodiment, the first weight screw 56*a* has a mass of approximately 10.30 grams, the second weight screw 58 has a mass of approximately 2.50 grams, the skid plate 54 has a mass of approximately 2.70 grams, and each of the nutplates (60*a* and 60*b*) have a mass of approximately 2.00 grams. Ideally, the crown 26 of the golf club head comprising the center of gravity adjustment assembly 40 has a mass of approximately 2.85 grams when composed of carbon. The sole 28 of the golf club head comprising the center of gravity adjustment assembly 40 has a mass of approximately 2.78 grams when composed of carbon.

Figure 3:
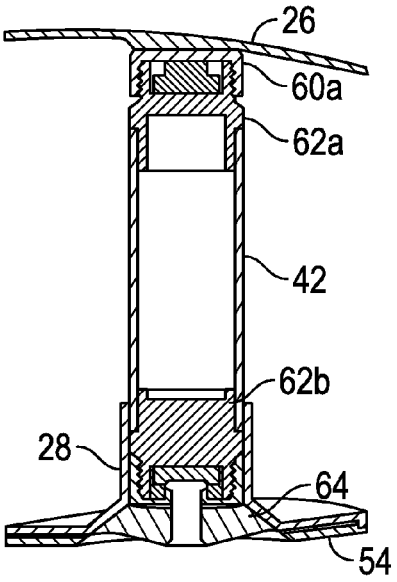
FIG. 3 is a cross sectional view of a golf club head comprising a third embodiment of a center of gravity height adjustment assembly.

As shown in FIG. 3, in a third embodiment of the center of gravity height adjustment assembly 40, the assembly 40 comprises a tube 42 and at least two weight pieces (62*a* and 62*b*). Preferably, the mass of the tube 42 ranges from 2.00 grams to 3.00 grams. Preferably, the mass of one of the at least two weight pieces (62*a* and 62*b*) is approximately 2.50 grams and the mass of the other at least two weight pieces (62*a* and 62*b*) is approximately 10.00 grams. The center of gravity height adjustment assembly 40 may further comprise a skid plate 54, a cap screw 64 and a nutplate 60*a*. In a preferred embodiment, the skid plate 54 has a mass of roughly 2.83 grams, the cap screw 64 has a mass of approximately 7.22 grams and the nutplate 60*a* has a mass of 1.41 grams. Preferably, the tube 42 has a mass of approximately 2.40 grams. Ideally, the crown 26 of the golf club head 20 comprising the center of gravity adjustment assembly 40 has a mass of approximately 2.53 grams when composed of carbon. The sole 28 of the golf club head 20 comprising the center of gravity adjustment assembly 40 has a mass of approximately 2.83 grams when composed of carbon.

Figure 4:
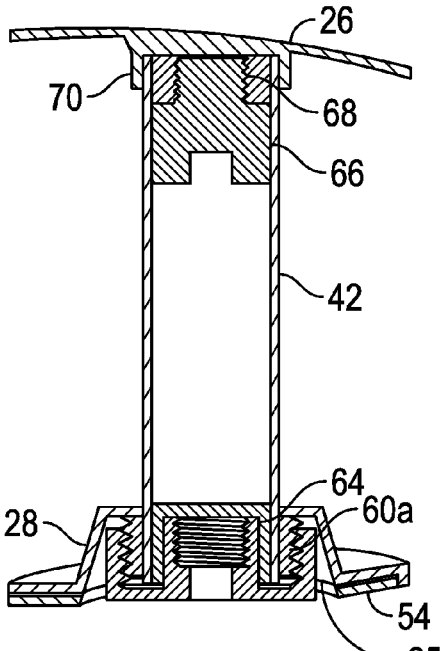
FIG. 4 is a cross sectional view of a golf club head comprising a fourth embodiment of a center of gravity height adjustment assembly.

As shown in FIG. 4, in a fourth embodiment, the center of gravity height adjustment assembly 40 comprises a tube 42, a weight screw 66 and a cap screw 64. The mass of the tube 42 is approximately between 3.00 grams and 4.00 grams. The mass of the weight screw 66 is approximately between 9.50 grams and 10.50 grams. Preferably, the mass of the cap screw 64 is between approximately 4.00 grams and 5.00 grams. Ideally, the mass of the tube 42 is 3.54 grams, the mass of the weight screw 66 is roughly 10.00 grams and the mass of the cap screw 64 is approximately 4.58 grams. The center of gravity height adjustment assembly 40 may further comprise a nut 68, a nutplate 60*a* and a skid plate 54. Preferably, the skid plate 54 has a mass of approximately 2.45 grams, the nut 68 has a mass of approximately 1.22 grams and the nutplate 60*a* has a mass of approximately 1.72 grams. Ideally, the crown 26 of the golf club head comprising 20 the center of gravity adjustment assembly 40 has a mass of approximately 3.08 grams when composed of carbon. The sole 28 of the golf club head 20 comprising the center of gravity adjustment assembly 40 has a mass of approximately 2.78 grams when composed of carbon.

A preferred design for a golf club head with at least two mass elements is found using the following equation:

$$D \geq 0.065(1+M/(M_b-M_a));$$

wherein D equals the distance between the two mass elements, M equals the mass of the golf club head, $M_b$ equals the mass of weighting element B, and $M_a$ equals the mass of weighting element A. A more preferred D is:

$$D \geq 0.095(1+M/(M_b-M_a))$$

Figure 12:
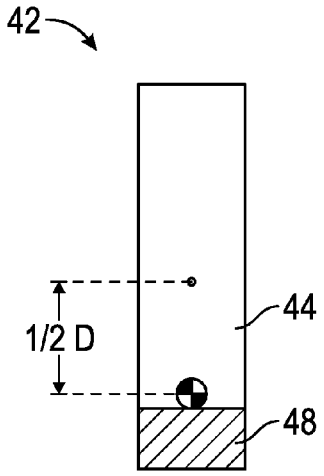
FIG. 12 is a perspective view of center of gravity height adjustment assembly comprising a tube wherein the distance from the midpoint of the tube to the center of gravity is shown.

Determining the preferred design for a golf club head incorporating a center of gravity height adjustment assembly 40 comprising a tube 42 is shown as:

$$D \geq 0.065(1+M/(M_t));$$

wherein $M_t$ is the mass of the tube when it holds the cartridge 44 and ½ D is the distance from the midpoint of the tube when it holds the cartridge 44 to the center of gravity, wherein the heavy end of the mass is closer to the sole of the golf club head. This distance is shown in FIG. 12.

Figure 6:
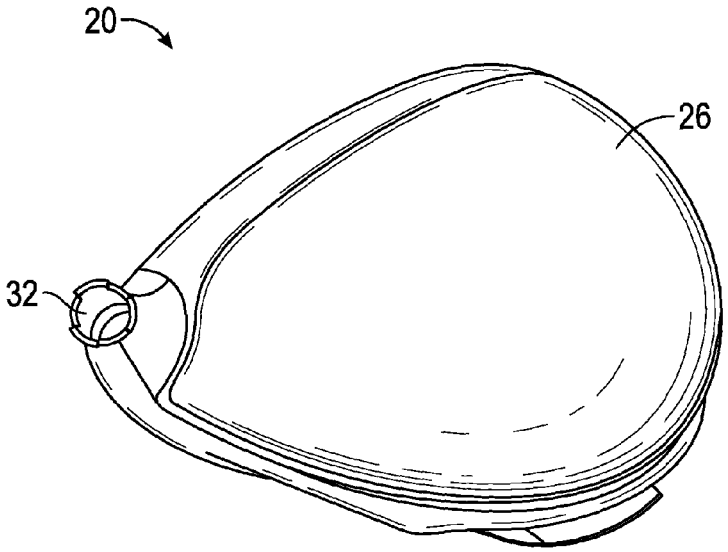
FIG. 6 is a top perspective view of a golf club head.
Figure 7:
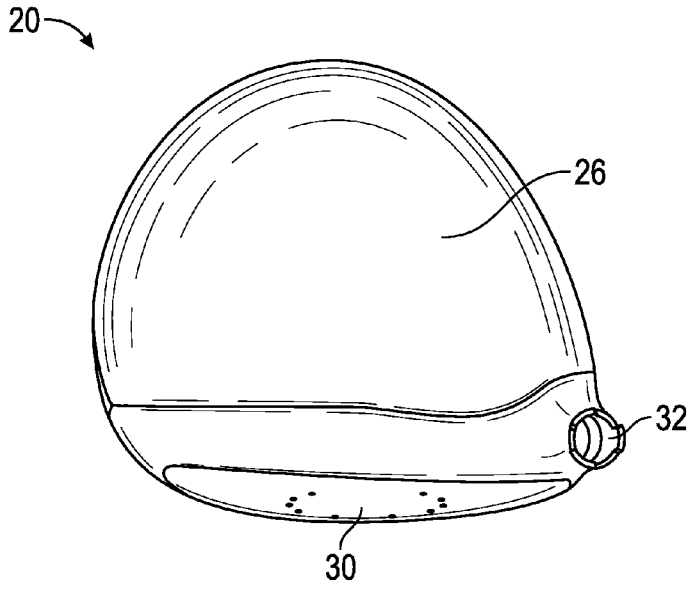
FIG. 7 is a top plan view of a golf club head.
Figure 8:
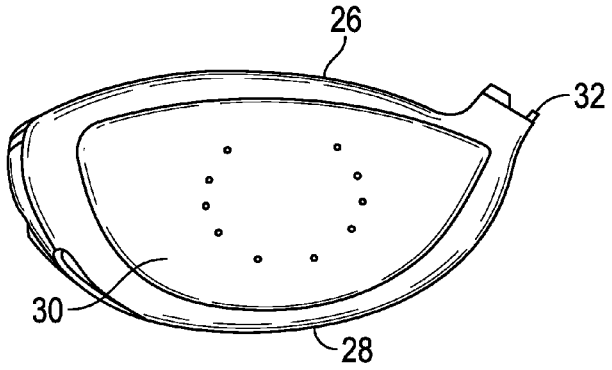
FIG. 8 is a front elevation view of a golf club head.

FIGS. 6-8 show the top perspective, top plan and front elevation views of a golf club head of the present invention. In each of the embodiments disclosed herein, the internal surface of the crown 26 may be modified by the addition of edge support structures 70, or rails, oriented fore and aft and aligned essentially parallel to the head Y-axis to hold the weighting system. These edge support structures 70 may be integrally molded from the crown parent material or be secondarily bonded to the crown 26. A benefit of the edge support structures 70 is that they increase stiffness of the crown to counteract the mass effect of the conformal weights, thus mitigating effects on vibrational behavior. In this manner the edge support structures 70 serve two functional roles; stiffener and weight guide.

Varying the amount of weight in the crown and sole may have an effect on driver sound at impact. A relatively flexible weight will mass load the crown thus affecting vibration modes with significant crown participation. This effect can be mitigated by the use of stiff edge restraint structures and matching the stiffness of the flexible weight system to the local crown structure.

Figure 9:
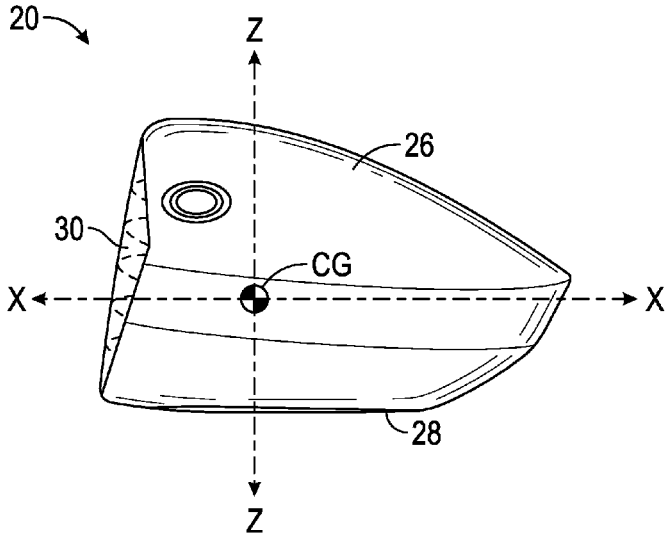
FIG. 9 is a heel side plan view of a golf club head of the present invention illustrating the Z and X axis.
Figure 10:
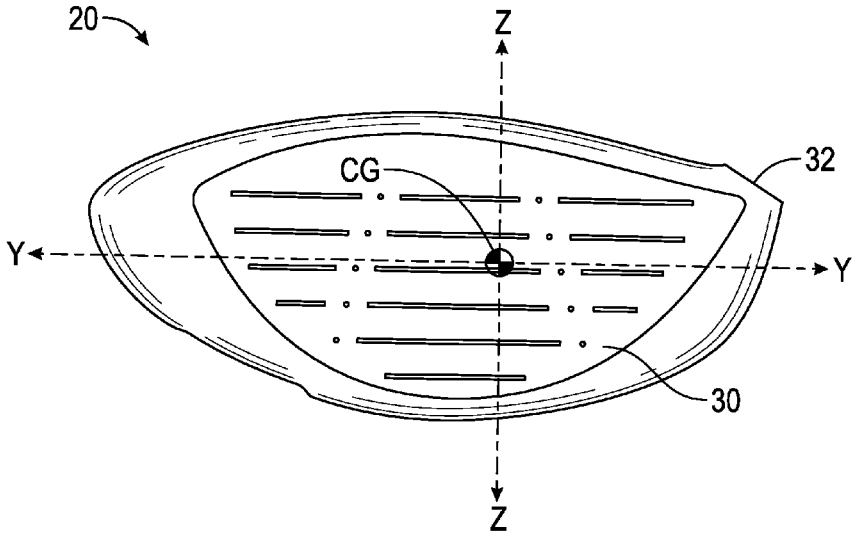
FIG. 10 is a front plan view of a golf club head of the present invention illustrating the Z axis and Y axis.
Figure 11:
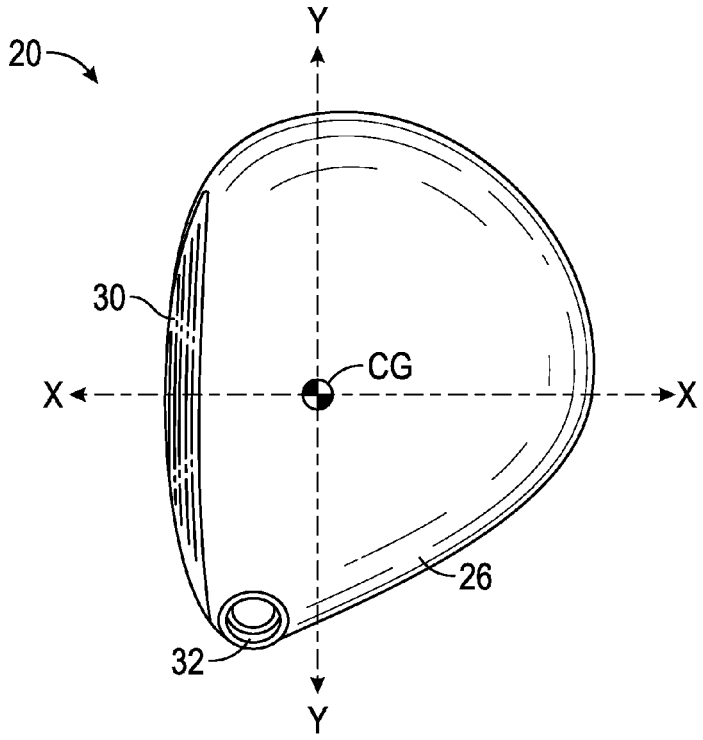
FIG. 11 is a top plan view of a golf club head of the present invention illustrating the X axis and Y axis.

FIGS. 9-11 illustrate the axes of inertia through the center of gravity of the golf club head. The axes of inertia are designated X, Y and Z. The X axis extends from the face of the golf club head through the center of gravity, CG, and to the rear of the golf club head. The Y axis extended from the heel end of the golf club head, through the center of gravity, CG, and to the toe end of the golf club head. The Z axis extends from the sole through the center of gravity, CG, and to the crown.

Figure 5:
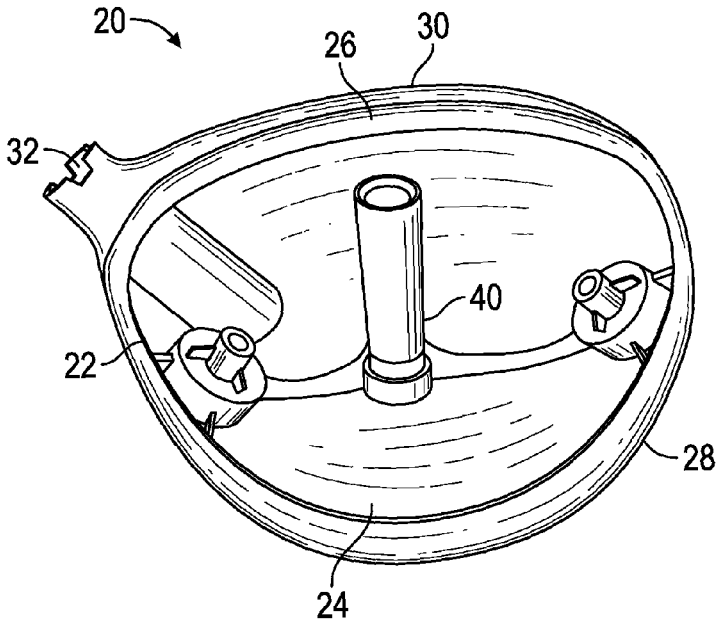
FIG. 5 is a perspective view of a golf club head with the crown removed to show the location of a center of gravity height adjustment assembly.
Figure 13:
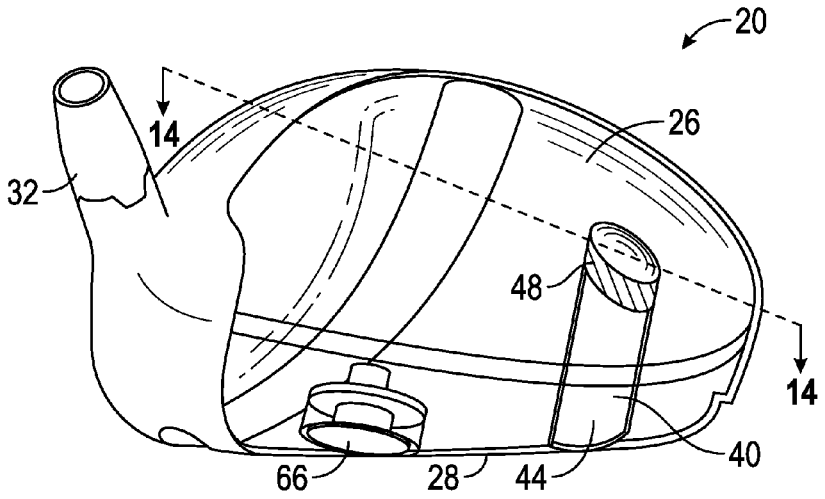
FIG. 13 is a transparent view of a golf club head with a sole weight extending from its sole to its crown.
Figures 15, 15A:
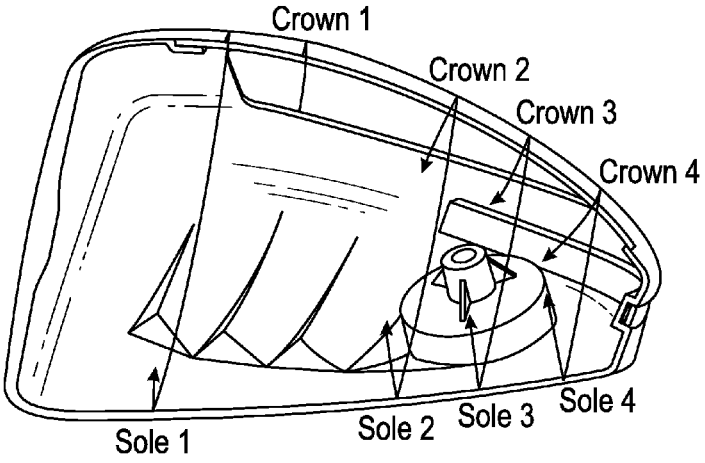
FIG. 15 is a table with various parameter measurements of a golf club head when a weight has differing mass values and locations, as shown in FIG. 15A.
FIG. 15A is a cross-sectional view of a golf club head corresponding to the table in FIG. 15 showing the movement of center of gravity height depending on the position of weights.

The center of gravity height adjustment assembly 40 is located within the hollow structure of the golf club head 20, in a crown to sole direction, running parallel to the tangent vector of the face 30. The center of gravity height adjustment occurs in the Z axis plane. Use of visible weights in the sole 28, as shown in FIG. 13, can result in a height adjustment of approximately 0.068 inch. Additional weights may be used as necessary. The center of gravity height adjustment assembly can be angled with respect to the head X-axis as shown in FIGS. 13 and 14 to accommodate performance or alignment needs without significant reduction in performance. The weight placement as shown in FIGS. 13 and 14 can provide a center of gravity height adjustment of approximately 0.085 inch, and may have the effects shown in the table provided in FIG. 15 depending on the location of the heaviest part of the weight near specific locations along the crown 26 and the sole 28, which are shown in FIG. 15A. As shown in this table, the height of the center of gravity can be adjusted by any of the values described as "delta height." Further, the cartridge 44 is not visible when the golf club 20 is at address. The weight placement in the top to bottom direction may be placed closer to the toe region, or closer to the heel region as shown in FIGS. 13 and 14, or closer to the face region as shown in FIG. 5.

The driver type golf club head 20 preferably has a volume of less than 400 cubic centimeters. The body 22 is preferably composed of a stainless steel material. The sole 28 is preferably composed of a metal material and the crown 26 is preferably composed of a non-metal material. The body 22 is alternatively composed of a titanium alloy material.

Alternatively, the golf club head 20 comprises a body 22 having a crown 26 composed of a carbon material, a sole 28 composed of carbon material, a face 30 and a hosel 32, wherein the body 22 defines a hollow 24 interior and a center of gravity height adjustment assembly 40 wherein the center of gravity height adjustment assembly 40 is positioned within the hollow interior 24 of the body 22 and the center of gravity of the golf club head 20 can be adjusted approximately 0.050 inch and 0.10 inch. The mass of the crown 26 composed of a carbon material ranges from approximately 2.25 grams to 3.50 grams. The mass of the sole 28 composed of a carbon material ranges from 2.50 grams to 3.50 grams. The mass of a crown 26 composed of a composite material ranges from 2.50 grams to 3.50 grams. The mass of a sole 28 composed of composite material ranges from 3.0 grams to 4.0 grams.

In one embodiment, the golf club head 20 comprises a body 22 having a crown 26 composed of a composite material, a sole 28 composed of a composite material, a face 30 and a hosel 32, wherein the body 22 defines a hollow interior 24. The center of gravity height assembly 40 is positioned within the hollow interior 24 of the body 22 and the center of gravity of the golf club head 20 can be adjusted approximately 0.050 inch and 0.10 inch.

In another embodiment, the golf club head 20 comprises a body 22 having a crown 26 composed of a tungsten material, a sole 28 composed of a composite material, a face 30 and a hosel 32, wherein the body 22 defines a hollow interior 24 and a center of gravity height adjustment assembly 40 is positioned within the hollow interior 24 of the body 22.

In another embodiment, shown in FIGS. 16-20, an adjustment plate 100 is attached to the sole 28 of the golf club head 20 beneath the center of gravity adjustment assembly 40. The adjustment plate 100 preferably has an uneven surface for the purpose of adjusting the face angle of the golf club head 20, and ultimately a golf club.

Figure 16:
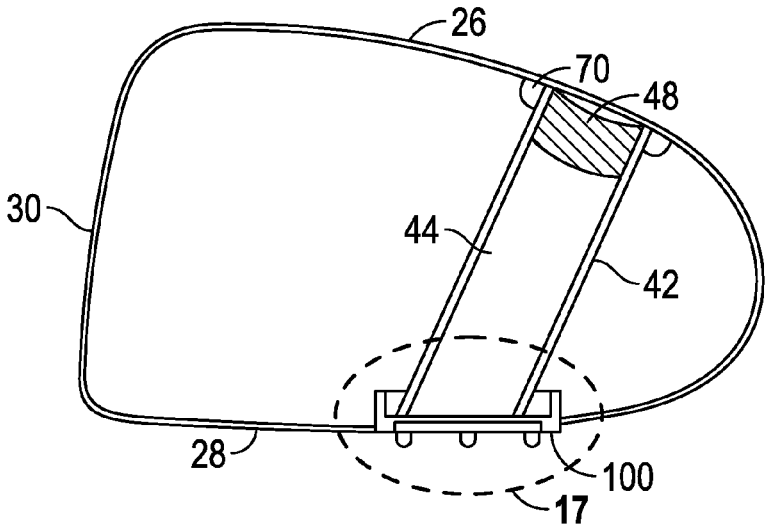
FIG. 16 is a cross-sectional view of one embodiment of a golf club head of the present invention with an adjustment plate on the sole.
Figure 17:
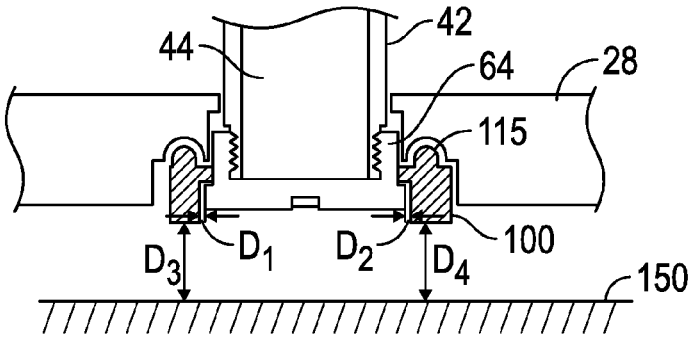
FIG. 17 is an enlarged view of the circled area in FIG. 16.
Figure 18:
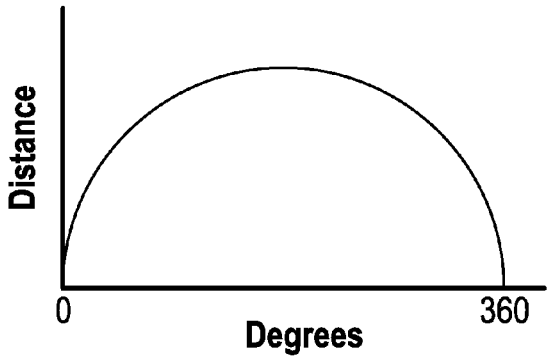
FIG. 18 is a graph of distance in height of the adjustment plate versus rotation from 0 to 360 degrees.

As shown in FIGS. 16 and 17, the adjustment plate 100 preferably comprises an adjustment ring 110 and a cap 120 that retains the cartridge 44 within the center of gravity adjustment assembly 40 for center of gravity height adjustment. The adjustment ring 110 is preferably a ring that encircles the cap screw 64 and varies its distance from both the cap screw 64 surface ($D_1$, $D_2$) and the ground plane 150 surface ($D_3$, $D_4$) such that rotation of the adjustment ring 110 varies the face angle of the golf club head 20 as shown in FIG. 18 and, in some embodiments, creates a dual keel. The adjustment ring 110 also preferably comprises an indexer 115, comprising nobs or splines, which allows the adjustment ring 110 to have distinct positions with respect to the cap screw 64 and the rest of the golf club head 20.

Figure 19:
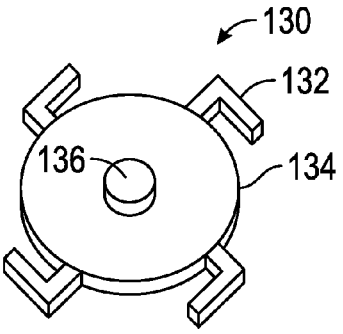
FIG. 19 is an isolated top view of a slide fastener embodiment of an adjustment plate of the present invention.
Figure 20:
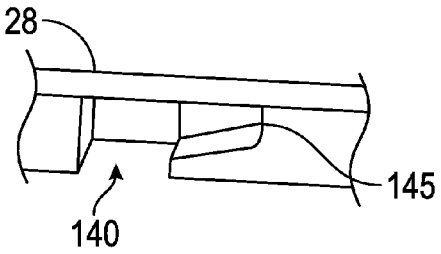
FIG. 20 is a side view of a capturing surface for a tang of the slide fastener shown in FIG. 19.

Alternatively, as shown in FIGS. 19 and 20, the adjustment ring 110 and cap screw 64 are combined into a four position slide cam-style fastener 130, which removes the need for threads. An equal number of tangs 132 and slots 134 surround a circumference of a hole 136 for a fit in different positions, such as four tangs equal to four different positions. FIG. 20 shows a receiving slot 140 that is disposed in the sole 28 of the club head 20 to receive a tang 132 of the cam-style fastener 130. The tang 132 slides into the receiving slot 140 and engages with an inclined surface 145 in the receiving slot 140 to hold the tang 132 in place.

The products of inertia (Ixz and Iyz) of the golf club head have an absolute value below 100 g-cm$^2$. Preferably, the products of inertia Ixz and Iyz are less than 50 g-cm$^2$, and most preferably the products of inertia Ixz and Iyz approach zero. The moment of inertia, Izz, about the Z axis for the golf club head 20 of the present invention will range from 2800 g-cm$^2$ to 5000 g-cm$^2$, preferably from 3000 g-cm$^2$ to 4500 g-cm$^2$, and most preferably from 3500 g-cm$^2$ to 4000 g-cm$^2$. The moment of inertia, Iyy, about the Y axis for the golf club head 20 of the present invention will range from 1500 g-cm$^2$ to 2500 g-cm$^2$, preferably from 1800 g-cm$^2$ to 2100 g-cm$^2$, and most preferably from 1900 g-cm$^2$ to 2050 g-cm$^2$. The golf club head will preferably have a volume ranging from 300 cubic centimeters (cc) to 600 cc, and more preferably from 325 cc to 525 cc. A more thorough description is provided in Cackett et al., U.S. Pat. No. 6,547,676 for a Golf Club Head That Optimizes Products Of Inertia, which is hereby incorporated by reference in its entirety. An additional description is provided in Kosmatka et al., U.S. Pat. No. 6,045,455 for Inertially Tailored Golf Club Heads, which is hereby incorporated by reference in its entirety.

The body 22 is composed of metals, composite materials, plastic materials and the like. In a preferred embodiment, the body 22 is composed of a plies of carbon pre-preg (pre-impregnated) sheets, or a similar non-metallic material. In an alternative embodiment, the body 22 is composed of a forged titanium alloy material. In another alternative embodiment, the body is composed of a forged steel material. In yet another alternative embodiment, the body 22 is composed of a cast titanium alloy material. Those skilled in the art will recognize that the body 22 may be composed of other materials without departing from the scope and spirit of the present invention.

Table one shows the impact frame inertia properties for a low CG impact frame neutral golf club head with a Cg(x) of 1.123, a Cg(y) of 0.017 and a Cg(z) of 0.109.

TABLE ONE

| Inertia Parameter | I(xx) | I(yy) | I(zz) | I(xy) | I(xz) | I(yz) |
|---|---|---|---|---|---|---|
| Value | 3194 | 2090 | 4006 | 418 | −43 | −23 |

Table Two shows the impact frame inertia properties for a high CG impact frame neutral golf club head with a Cg(x) of 1.108, a Cg(y) of 0.017 and a Cg(z) of 0.193.

TABLE TWO

| Inertia Parameter | I(xx) | I(yy) | I(zz) | I(xy) | I(xz) | I(yz) |
|---|---|---|---|---|---|---|
| Value | 3237 | 2113 | 3985 | 413 | 10 | 0 |

Table Three shows the impact frame inertia properties for a high CG impact frame draw golf club head with a Cg(x) of 1.107, a Cg(y) of −0.081 and a Cg(z) of 0.184.

TABLE THREE

| Inertia Parameter | I(xx) | I(yy) | I(zz) | I(xy) | I(xz) | I(yz) |
|---|---|---|---|---|---|---|
| Value | 3128 | 2115 | 3867 | 296 | 0 | 24 |

Table Four shows the impact frame inertia properties for a low CG impact frame draw golf club head with a Cg(x) of 1.122, a Cg(y) of −0.081 and a Cg(z) of 0.100.

TABLE FOUR

| Inertia Parameter | I(xx) | I(yy) | I(zz) | I(xy) | I(xz) | I(yz) |
|---|---|---|---|---|---|---|
| Value | 3083 | 2090 | 3888 | 302 | −53 | −10 |

U.S. Pat. No. 7,147,573 to DiMarco is hereby incorporated by reference in its entirety.

Gibbs, et al., U.S. Pat. No. 7,163,468, which discloses various wood-type golf club head embodiments, is hereby incorporated by reference in its entirety.

Galloway, et al., U.S. Pat. No. 7,163,470 is hereby incorporated by reference in its entirety.

Williams, et al., U.S. Pat. No. 7,166,038 is hereby incorporated by reference in its entirety.

Desmukh U.S. Pat. No. 7,214,143 is hereby incorporated by reference in its entirety.

Murphy, et al., U.S. Pat. No. 7,252,600 is hereby incorporated by reference in its entirety.

Gibbs, et al., U.S. Pat. No. 7,258,626 is hereby incorporated by reference in its entirety.

Galloway, et al., U.S. Pat. No. 7,258,631 is hereby incorporated by reference in its entirety.

Evans, et al., U.S. Pat. No. 7,273,419 is hereby incorporated by reference in its entirety.

Foster, et al., U.S. Pat. No. 8,337,328 is hereby incorporated by reference in its entirety.

Evans, et al., U.S. Pat. No. 8,317,636 is hereby incorporated by reference in its entirety.

Watson, et al., U.S. Pat. No. 8,262,506 is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A wood-type golf club head comprising:

a metal body comprising a face, a rear portion, and a sole;

a crown;

a hollow tube; and a cartridge removably positioned within the hollow tube comprising a first material having a first specific gravity and a second material having a second specific gravity that is greater than the value of the first specific gravity;

wherein the tube extends from the crown to the sole;

wherein changing the orientation of the cartridge within the hollow tube changes the location of the center of gravity of the wood-type golf club head along a vertical Z axis;

wherein the products of inertia (Ixz and Iyz) of the golf club head have an absolute value below 100 g-cm$^2$.

2. The wood-type golf club head of claim 1, wherein the first material is a polymer and wherein the second material is tungsten.

3. The wood-type golf club head of claim 1, wherein the products of inertia (Ixz and Iyz) of the golf club head have an absolute value below 50 g-cm$^2$.

4. The wood-type golf club head of claim 1, further comprising a cap, wherein the cap is sized to fit within an opening in the sole.

5. The wood-type golf club head of claim 1, wherein the body is composed of a titanium alloy material.

6. The wood-type golf club head of claim 1, further comprising at least one weight screw.

7. The wood-type golf club head of claim 1, wherein changing the orientation of the cartridge within the tube changes the location of the center of gravity by no less than 0.050 inch along a vertical Z axis.

8. The wood-type golf club head of claim 7, wherein changing the orientation of the cartridge within the tube changes the location of the center of gravity by at approximately 0.070 inch along a vertical Z axis.

9. The wood-type golf club head of claim 7, wherein changing the orientation of the cartridge within the tube changes the location of the golf club head center of gravity by 0.068 inch to 0.085 inch along the vertical Z axis.

10. The wood-type golf club head of claim 1, wherein the golf club head comprises an adjustable hosel.

11. The wood-type golf club head of claim 1, wherein the golf club head comprises an adjustable plate on the sole.

12. The wood-type golf club head of claim 1, wherein the tube is disposed closer to the face than to the rear portion.

13. The wood-type golf club head of claim 1, wherein the cartridge comprises a first tapered end and a second tapered end.

* * * * *